US012595142B2

(12) United States Patent
Ohno

(10) Patent No.: US 12,595,142 B2
(45) Date of Patent: Apr. 7, 2026

(54) SHEET FEEDER

(71) Applicant: TOSHIBA TEC KABUSHIKI KAISHA, Tokyo (JP)

(72) Inventor: Masahiro Ohno, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/429,486

(22) Filed: Feb. 1, 2024

(65) Prior Publication Data

US 2024/0391714 A1 Nov. 28, 2024

(30) Foreign Application Priority Data

May 24, 2023 (JP) ..... 2023-085775

(51) Int. Cl.

| | |
|---|---|
| ***B65H 5/38*** | (2006.01) |
| ***B65H 1/04*** | (2006.01) |
| *B65H 3/06* | (2006.01) |
| *B65H 5/06* | (2006.01) |

(52) U.S. Cl.

CPC ..... *B65H 1/04* (2013.01); *B65H 3/06* (2013.01); *B65H 5/062* (2013.01); *B65H 5/38* (2013.01); *B65H 2405/1138* (2013.01)

(58) Field of Classification Search

CPC ... B65H 1/04; B65H 3/68; B65H 5/38; B65H 2405/113; B65H 2405/1132; B65H 2405/1138

See application file for complete search history.

(56) References Cited

U.S. PATENT DOCUMENTS

| | | | | |
|---|---|---|---|---|
| 5,265,856 | A | 11/1993 | Walker | |
| 6,908,081 | B2 * | 6/2005 | Takito | B65H 3/56 271/167 |
| 8,398,071 | B2 * | 3/2013 | Suzuki | B65H 3/48 271/104 |
| 8,419,012 | B2 * | 4/2013 | Otsuki | B65H 1/266 271/145 |
| 8,424,866 | B2 * | 4/2013 | Ikeda | B65H 3/48 271/97 |
| 10,023,410 | B2 * | 7/2018 | Hashimoto | B65H 1/04 |
| 10,549,935 | B2 * | 2/2020 | Tokoro | B65H 1/04 |
| 11,198,572 | B2 * | 12/2021 | Tokoro | B65H 5/06 |
| 2021/0229950 | A1 * | 7/2021 | Ishikawa | H04N 1/00612 |

FOREIGN PATENT DOCUMENTS

| | | |
|---|---|---|
| JP | 2005-289559 | 10/2005 |
| JP | 2014210634 A * | 11/2014 |

* cited by examiner

*Primary Examiner* — Michael McCullough

(74) *Attorney, Agent, or Firm* — Amin, Turocy & Watson, LLP

(57) ABSTRACT

A sheet feeder includes a cassette has a sheet container space configured to hold a sheet having a wireless tag. The cassette feeds the sheet to a first side in a first direction. A horizontal direction orthogonal to the first direction is a second direction. A range in the second direction occupied by the wireless tag of the sheet held in the sheet container space is a first range. A range in the second direction including at least a part of the first range is a second range. A range in the second direction occupied by the sheet container space is a third range. In the cassette front wall, a height in a vertical direction in the third range except the second range is smaller than a height in the vertical direction in the second range.

17 Claims, 4 Drawing Sheets

SHEET FEEDER

CROSS-REFERENCE TO RELATED APPLICATION

This application is based upon and claims the benefit of priority from Japanese Patent Application No. 2023-085775, filed on May 24, 2023, the entire contents of which are incorporated herein by reference.

FIELD

Embodiments described herein relate to a sheet feeder.

BACKGROUND

An image forming apparatus forms an image on a sheet. The image forming apparatus has a sheet feeder feeding a sheet. A sheet feeder that may suppress a feeding failure of a sheet is required.

DETAILED DESCRIPTION

A challenge to be solved is to provide a sheet feeder that may suppress a feeding failure of a sheet.

A sheet feeder of an embodiment includes a cassette and a cassette front wall. The cassette has a sheet container space configured to hold a sheet having a wireless tag. The cassette feeds the sheet to a first side in a first direction. The cassette front wall is a front wall of the cassette located at the first side in the first direction of the sheet container space. A horizontal direction orthogonal to the first direction is a second direction. A range in the second direction occupied by the wireless tag of the sheet held in the sheet container space is a first range. A range in the second direction including at least a part of the first range is a second range. A range in the second direction occupied by the sheet container space is a third range. In the cassette front wall, a height in a vertical direction in the third range except the second range is smaller than a height in the vertical direction in the second range.

As below, a sheet feeder of an embodiment will be explained with reference to the drawings.

Figure 1:
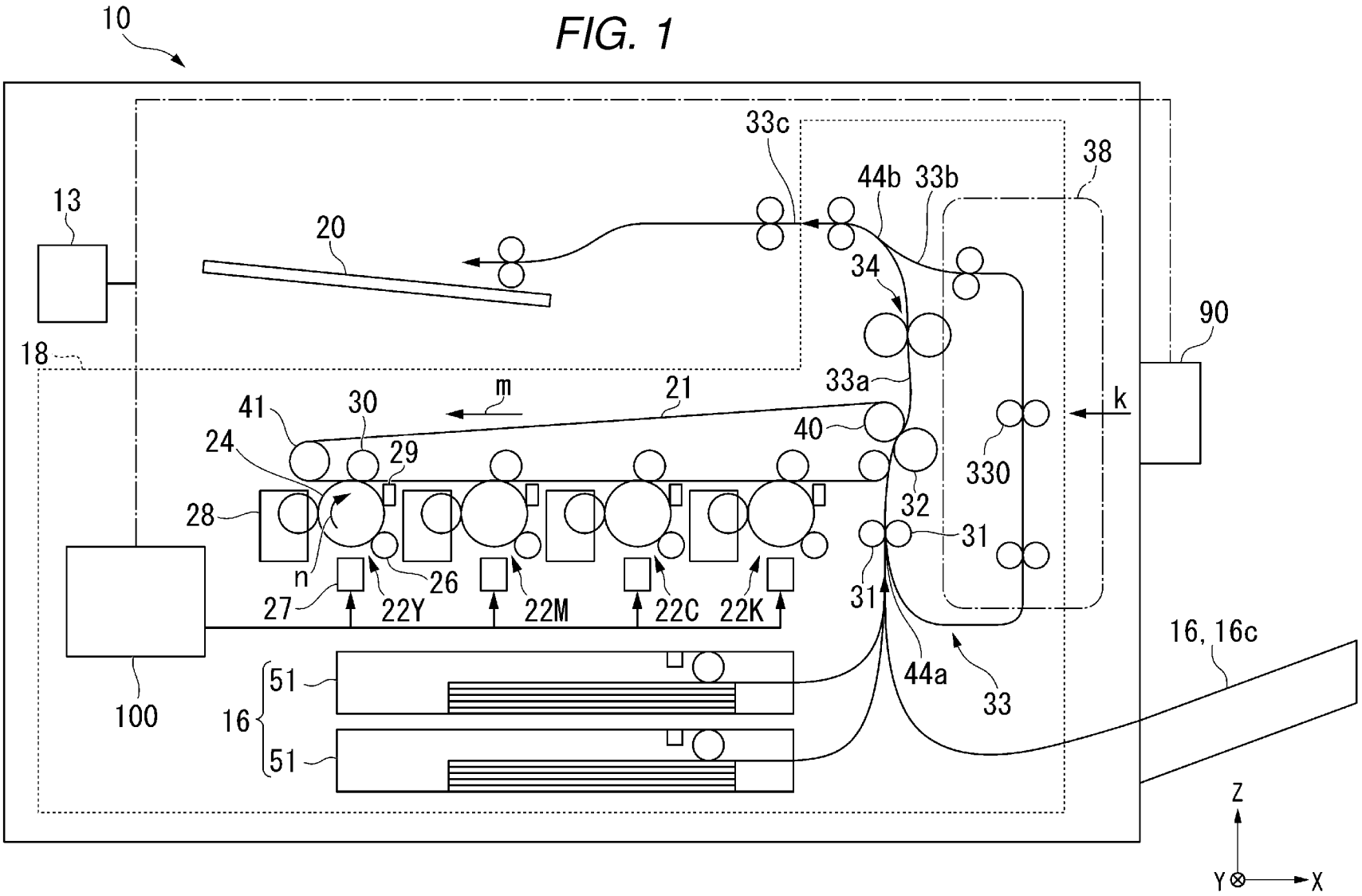
FIG. 1 is an explanatory diagram showing an example of a configuration of an image forming apparatus.

First, a configuration of an image forming apparatus 10 of an embodiment will be explained using FIG. 1. FIG. 1 is an explanatory diagram showing an example of the configuration of the image forming apparatus 10. For example, the image forming apparatus 10 is placed in a workplace such as an office.

In this application, Z directions, X directions, and Y directions of an orthogonal coordinate system are defined as follows. The Z directions are upward and downward directions of the image forming apparatus 10 and the +Z direction is the upward direction. The X directions are leftward and rightward directions of the image forming apparatus 10 and the +X direction is the rightward direction. The Y directions (second directions) are anterior and posterior directions of the image forming apparatus 10. In the Y directions, a side closer to the center of a sheet feed cassette 51 may be referred to as "inside" and a side farther from the center of the sheet feed cassette 51 may be referred to as "outside". For example, the Z directions are vertical directions and the X directions and the Y directions are horizontal directions.

In FIG. 1, the image forming apparatus 10 includes a control panel 13, a wireless tag communication device 90, and a printer section 18. The printer section 18 includes a control unit 100, sheet feed cassettes 51, etc. The control unit 100 controls the control panel 13, the wireless tag communication device 90, and the printer section 18. The control unit 100 controls sheet conveyance in the printer section 18. The control of the sheet conveyance refers to control of a sheet conveyance time, a sheet stop position, a sheet conveyance speed, etc.

The control panel 13 includes an input key and a display unit. For example, the input key receives input by a user. For example, the display unit is of a touch panel type. The display unit receives input by the user and displays to the user. For example, the control panel 13 displays items relating to operation of the image forming apparatus 10 to be settable on the display unit. The control panel 13 notifies the control unit 100 of the items set by the user.

The sheet feed cassettes 51 hold the sheets provided with wireless tags. Note that, obviously, the sheet feed cassettes 51 may hold sheets without wireless tags. In the following explanation, the sheets are sheets with wireless tags unless otherwise noted. For the sheets, e.g., materials such as paper or plastic films are used.

The printer section 18 performs operation of forming an image. For example, the printer section 18 forms an image represented by image data on a sheet. In the following explanation, formation of an image on a sheet is also referred to as "printing". Note that, in the embodiment, the printer section 18 is a device for fixing a toner image, but not limited to that. An inkjet device may be used.

The printer section 18 includes an intermediate transfer belt 21. The printer section 18 supports the intermediate transfer belt 21 using a driven roller 41, a backup roller 40, etc. The printer section 18 rotates the intermediate transfer belt 21 in a direction of an arrow m. The printer section 18 includes four sets of image forming stations 22Y, 22M, 22C, and 22K. The image forming stations 22Y, 22M, 22C, and 22K correspond to Y (yellow), M (magenta), C (cyan), and K (black), respectively. The image forming stations 22Y, 22M, 22C, and 22K are placed along the rotation direction of the intermediate transfer belt 21 under the intermediate transfer belt 21.

As below, of the respective image forming stations 22Y, 22M, 22C, and 22K, the Y (yellow) image forming station 22Y will be explained as an example. Note that the image forming stations 22M, 22C, and 22K have the same configuration as the image forming station 22Y and the detailed explanation thereof will be omitted.

The image forming station 22Y includes a primary transfer roller 30. The primary transfer roller 30 is placed to face a photoreceptor drum 24 via the intermediate transfer belt 21.

The image forming station 22Y includes an electric charger 26, an exposure scanning head 27, a developing device 28, and a photoreceptor cleaner 29. The electric charger 26, the exposure scanning head 27, the developing device 28, and the photoreceptor cleaner 29 are placed around the photoreceptor drum 24 rotating in a direction of an arrow n.

The electric charger 26 uniformly charges the photoreceptor drum 24. The exposure scanning head 27 exposes the uniformly charged photoreceptor drum 24 to light and forms an electrostatic latent image on the photoreceptor drum 24. The developing device 28 develops the electrostatic latent image on the photoreceptor drum 24 using a developer having two components formed using toner and carrier.

The primary transfer roller 30 primarily transfers a toner image formed on the photoreceptor drum 24 to the intermediate transfer belt 21. The respective primary transfer rollers 30 of the image forming stations 22Y, 22M, 22C, and 22K primarily transfer toner images to the intermediate transfer belt 21, and thereby, a color toner image is formed on the intermediate transfer belt 21. The color toner image is a toner image formed by sequential superimposition of the toner images of Y (yellow), M (magenta), C (cyan), and K (black). The photoreceptor cleaner 29 removes the toner left on the photoreceptor drum 24 after the primary transfer.

The printer section 18 includes a secondary transfer roller 32. The secondary transfer roller 32 is placed to face the backup roller 40 via the intermediate transfer belt 21. The secondary transfer roller 32 collectively secondarily transfers the color toner image on the intermediate transfer belt 21 to a sheet. Note that, in the following explanation, "toner image" may be either a color toner image or a monochromatic toner image. Or, the toner image may be a toner image using a decolorable toner.

A conveyance path 33 is a path in which a sheet is conveyed by a plurality of conveyance rollers (e.g., a conveyance roller 330 etc.) The conveyance path 33 includes a first conveyance path 33*a*, a second conveyance path 33*b*, and a third conveyance path 33*c*. The first conveyance path 33*a* is a conveyance path from a combined portion 44*a* to a branched portion 44*b*. The second conveyance path 33*b* is a conveyance path passing through a duplex printing device 38 from the branched portion 44*b* to the combined portion 44*a* different from the first conveyance path 33*a*. The third conveyance path 33*c* is a conveyance path from the branched portion 44*b* to an ejection tray 20.

A sheet is drawn out from a sheet stack unit 16 of one of the sheet feed cassette 51 and a manual feed tray 16*c*. The sheet drawn out from the sheet stack unit 16 is temporarily stopped in a part in which two resist rollers 31 in rest contact. Here, the leading end of the sheet is brought into contact with the resist rollers 31 and the inclination of the sheet is corrected. The control unit 100 moves the sheet to the position of the secondary transfer roller 32 by starting the rotation of the resist rollers 31 according to the position of the toner image on the rotating intermediate transfer belt 21.

The toner image formed on the intermediate transfer belt 21 is secondarily transferred to the sheet by the secondary transfer roller 32. Further, the secondarily transferred toner image is fixed to the sheet by a fixing device 34. In this manner, an image is formed on the sheet under control of the control unit 100. The control unit 100 conveys the sheet with the toner image fixed by the fixing device 34 to the third conveyance path 33*c* and ejects the sheet.

The wireless tag communication device 90 includes an arithmetic unit, a memory unit, and an antenna (not shown). The wireless tag in the embodiment is e.g., an RFID (Radio Frequency Identifier) tag. For example, the wireless tag communication device 90 transmits radio wave in a direction of an arrow k. The wireless tag communication device 90 communicates with the wireless tag provided on the sheet via the antenna. Specifically, the wireless tag communication device 90 reads information from the wireless tag and writes information in the wireless tag.

For example, when a sheet is used for distribution or the like, the information written in the wireless tag contains information representing a content, information representing an address, details printed on the sheet, etc. In the embodiment, the wireless tag communication device 90 uses e.g. a 900 MHz-band radio system (UHF). Note that the RFID system and the frequency band are not limited to those, but other system and frequency band can be employed.

The control unit 100 performs control of the respective parts of the image forming apparatus 10.

Figure 2:
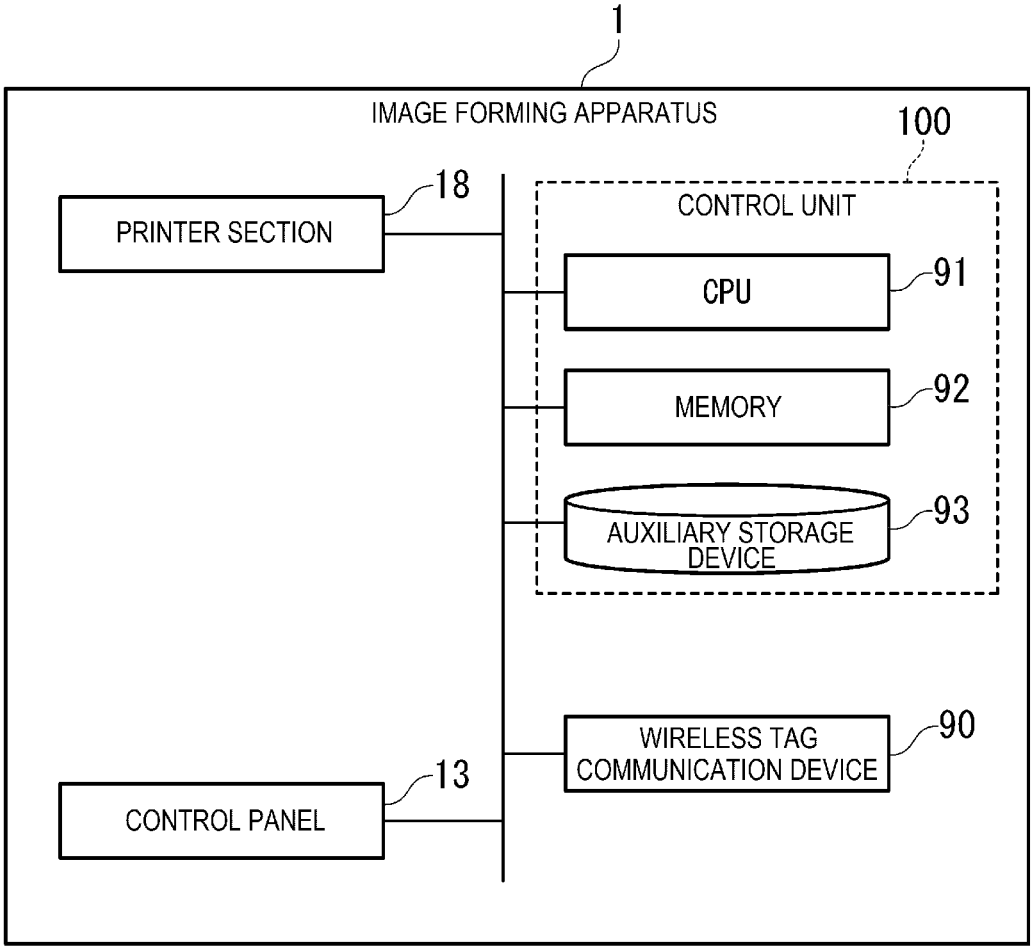
FIG. 2 shows a hardware configuration diagram of the image forming apparatus.

FIG. 2 shows a hardware configuration diagram of the image forming apparatus. The image forming apparatus 10 includes a CPU (Central Processing Unit) 91, a memory 92, an auxiliary storage device 93, etc. connected by a bus, and executes programs. The image forming apparatus 10 functions as an apparatus including the printer section 18, the control panel 13, and the wireless tag communication device 90 by executing the programs.

The CPU 91 functions as the control unit 100 by executing the programs stored in the memory 92 and the auxiliary storage device 93. The control unit 100 controls operation of the respective functional units of the image forming apparatus 10.

The auxiliary storage device 93 is formed using a storage device such as a magnetic hard disk device, a semiconductor storage device, or the like. The auxiliary storage device 93 stores information.

Figure 3:
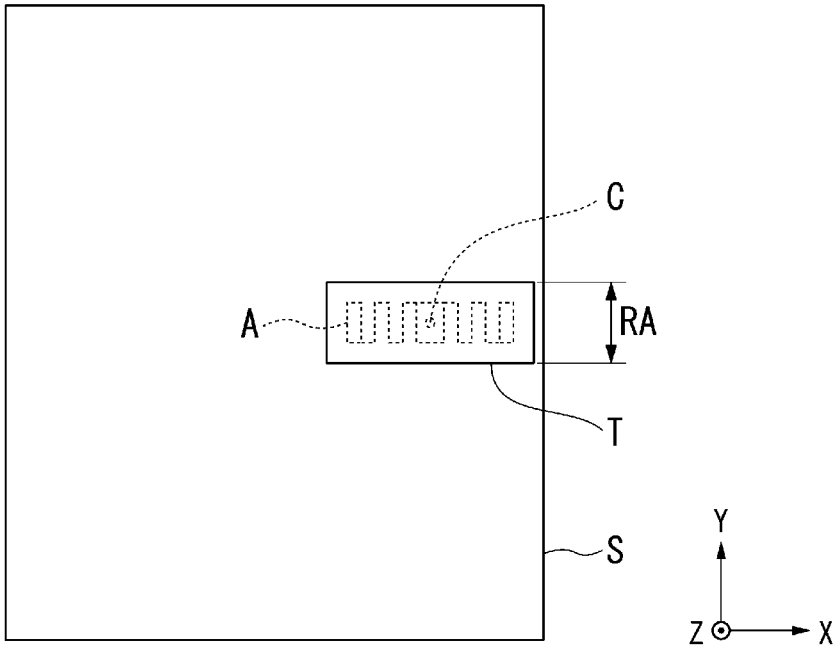
FIG. 3 is a plan view of a sheet having a wireless tag.

FIG. 3 is a plan view of a sheet S having a wireless tag T. FIG. 3 shows the sheet S held in the sheet feed cassette 51. In FIG. 3, the thickness direction of the sheet S is aligned with the Z directions and the width direction is aligned with the Y directions.

For example, the sheet S is a standard-size sheet. The image forming apparatus 10 forms images on standard-size sheets having various sizes. Of the sizes of the standard-size sheets, A-series sizes including A4 are specified in International Standard ISO 216 specifying dimensions of paper. B-series sizes including B5 are defined in ISO 216 or Japanese Industrial Standards JIS-B series. LT is a letter size and specified as ANSI A in American National Standards Institute ANSI/ASME Y14.1. LG is a legal size. In this application, of the standard-size sheets on which images can be formed in the image forming apparatus 10, the standard-size sheet having the largest width in the Y directions is defined as the maximum standard-size sheet.

The sheet S has the wireless tag T.

The wireless tag T is placed inside in the thickness direction of the sheet S. The wireless tag T may be attached to the front surface of the sheet S. For example, the wireless tag T is placed in an end portion in the +X direction in the center portion in the Y directions of the sheet S. The wireless tag T may be placed in a position different from that in FIG. 3. The wireless tag T has a rectangular shape as seen from the Z directions. For example, the wireless tag is placed on the sheet S with the longitudinal direction along the X directions and the lateral direction in the Y directions. The wireless tag T may be placed on the sheet S in an orientation different from that in FIG. 3.

The wireless tag T has an antenna A and an IC chip C. The antenna A transmits and receives radio waves or the like between the wireless tag communication device 90 and itself. The IC chip C records and processes information. The wireless tag T has a thickness in the Z directions. The thickness of the sheet S in a part in which the wireless tag T is placed is larger than those in the other parts. Particularly, the thickness of the sheet S in a part in which the IC chip C is placed is larger than those in the other parts.

Figure 4:
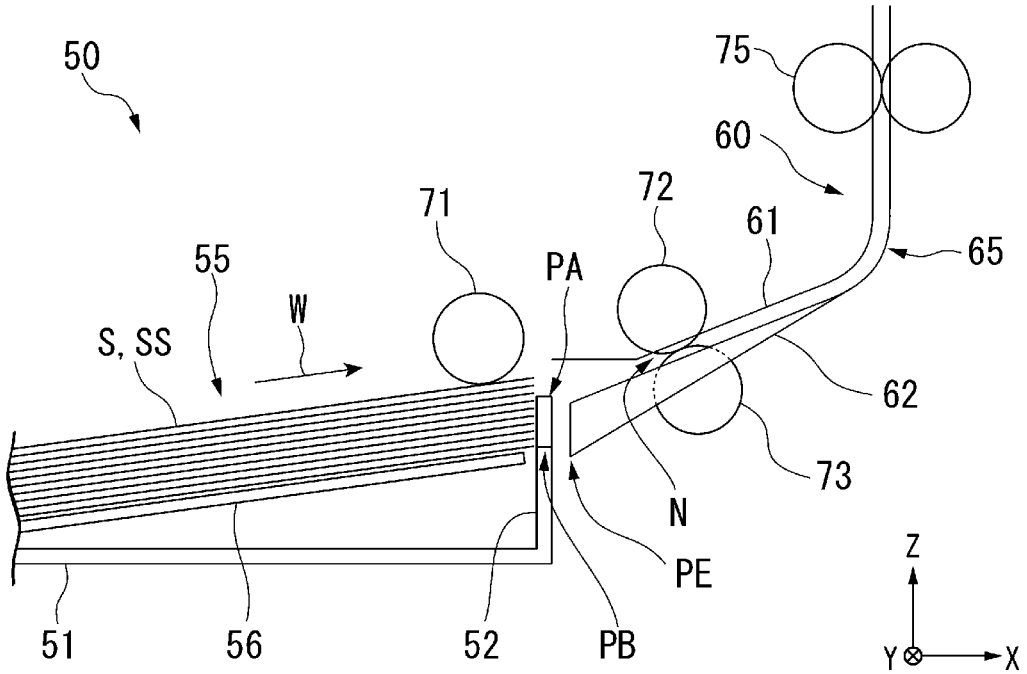
FIG. 4 is a front sectional view of a sheet feeder.
Figure 5:
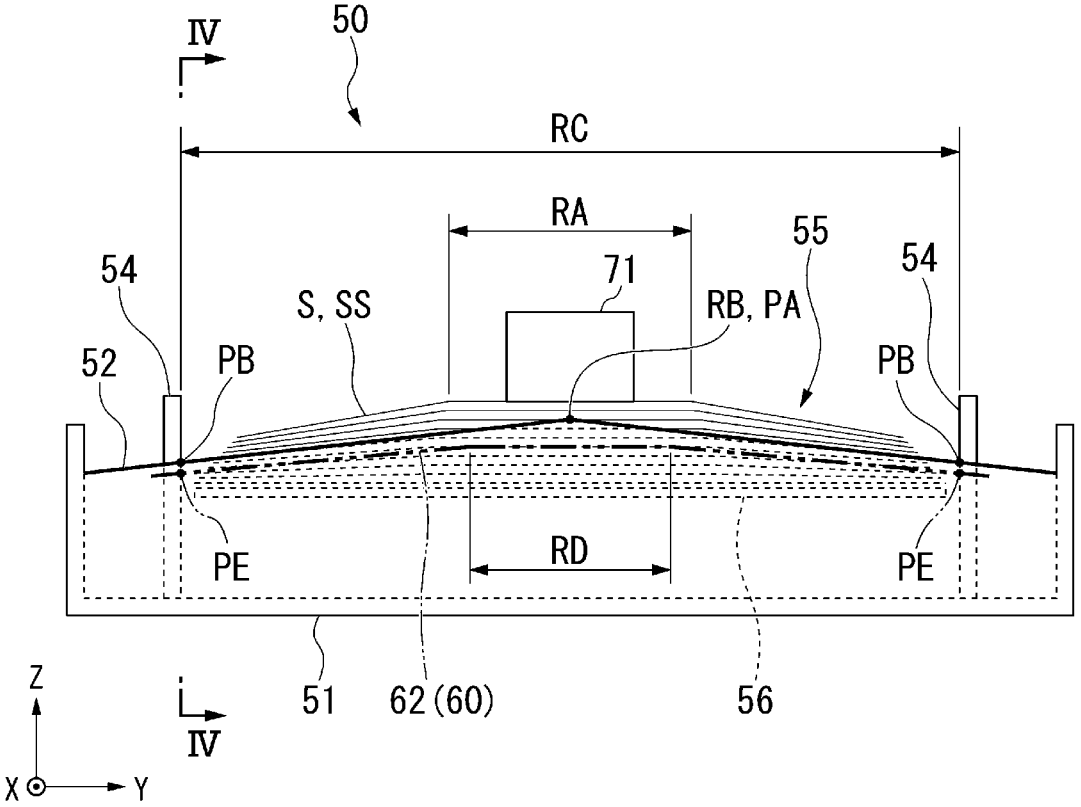
FIG. 5 is a side view of a sheet feed cassette and a pickup roller.
Figure 6:
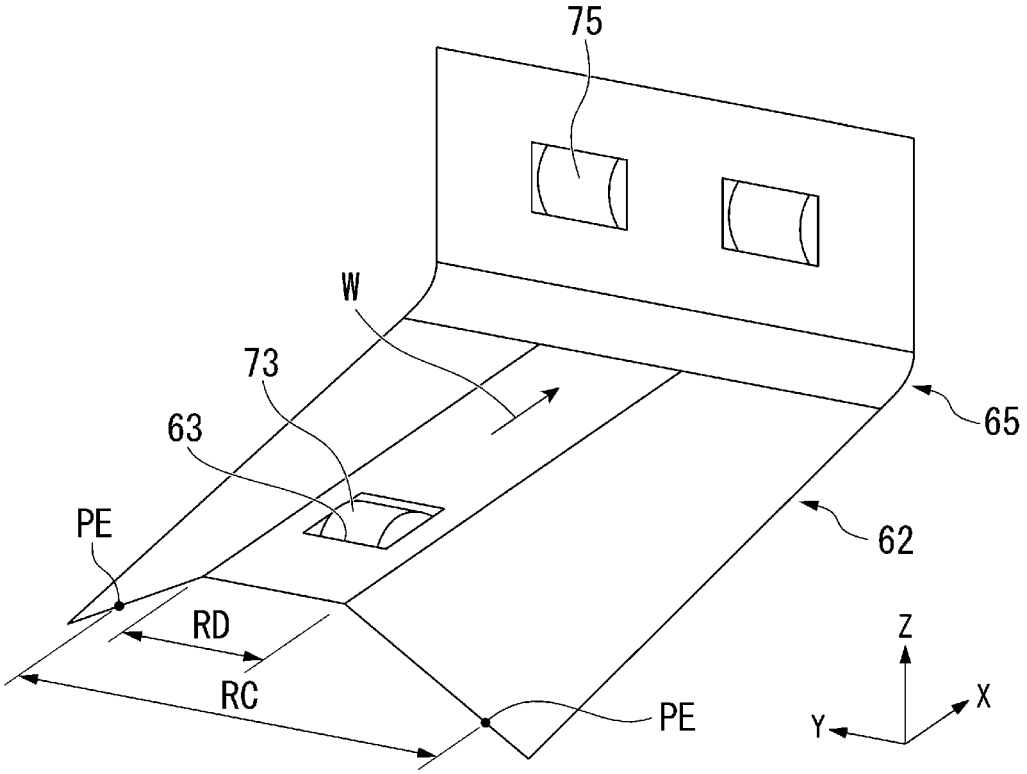
FIG. 6 is a perspective view of a lower surface guide and a bent portion of a conveyance guide.

FIG. 4 is a front sectional view of a sheet feeder 50 along line IV-IV in FIG. 5. FIG. 5 is a side view of the sheet feed cassette 51 and a pickup roller 71. FIG. 6 is a perspective view of a lower surface guide 62 and a bent portion 65 of a conveyance guide 60. As shown in FIG. 4, the sheet feeder 50 has the sheet feed cassette (cassette) 51.

The sheet feed cassette 51 has a box shape opening in the +Z direction. The sheet feed cassette 51 has a cassette front wall 52. The cassette front wall 52 is a side wall in the +X direction of the sheet feed cassette 51.

As shown in FIG. 5, the sheet feed cassette 51 has side guides 54, a sheet container space 55, and a sheet feed tray 56.

The side guides 54 are placed inside of the sheet feed cassette 51. The side guides 54 have plate shapes and are parallel to the XZ-plane. A pair of the side guides 54 are placed apart in the Y directions. The pair of side guides 54 are movable to the inside and the outside in the Y directions in synchronization with each other. The pair of side guides 54 contact end portions in the Y directions of the sheet S and align the sheet S in the Y directions. The center in the Y directions of the sheet S is placed at the center in the Y directions of the sheet feed cassette 51.

The sheet container space 55 is a space inside in the Y directions of the pair of side guides 54. The sheet container space 55 can hold the maximum standard-size sheets. The sheet container space 55 can hold the sheet S having the wireless tag T.

The sheet feed tray 56 is placed in the bottom part of the sheet container space 55. As shown in FIG. 4, the sheet feed tray 56 is pivotable around a pivot axis. The pivot axis is parallel to the Y directions and is placed in an end portion in the −X direction of the sheet feed tray 56. By the pivot of the sheet feed tray 56, an end portion in the +X direction of the sheet feed tray 56 moves in the Z directions. A bundle of sheets SS in which a plurality of sheets S are stacked in the thickness direction is mounted on the upper surface of the sheet feed tray 56. By the pivot of the sheet feed tray 56, an end portion in the +X direction of the bundle of sheets SS moves in the Z directions.

The sheet feeder 50 has the pickup roller 71.

The pickup roller 71 is placed in the +Z direction of the sheet feed cassette 51. The pickup roller 71 is placed in a position corresponding to the end portion in the +X direction in the center portion in the Y directions of the sheet feed cassette 51. The pickup roller 71 rotates around the rotation axis parallel to the Y directions. The pickup roller 71 is rotationally driven by a motor or the like. The pickup roller 71 is movable in the Z directions.

The sheet feed operation of the pickup roller 71 is explained. In the resting state of the image forming apparatus 10, the sheet feed tray 56 moves downward to the bottom surface of the sheet feed cassette 51 and the pickup roller 71 moves upward in the +Z direction. The user of the image forming apparatus 10 draws out the sheet feed cassette 51 from the image forming apparatus 10. The user fills the sheet container space 55 of the sheet feed cassette 51 with the bundle of sheets SS.

The user presses the sheet feed cassette 51 into the image forming apparatus 10. The pickup roller 71 moves downward. The sheet feed tray 56 pivots and raises the end portion in the +X direction of the bundle of sheets SS. The pickup roller 71 contacts the upper surface of the uppermost sheet S in the raised bundle of sheets SS. When the pickup roller 71 is raised to a predetermined position, the rotation switch of the pickup roller 71 is turned on. The pivot of the sheet feed tray 56 stops. FIGS. 4 and 5 show the states. The pickup roller 71 rotates and supplies the uppermost sheet S in a +W direction.

At each time when the sheet S is fed, the pickup roller 71 moves downward little by little. When the pickup roller 71 moves downward to a predetermined position, the rotation switch of the pickup roller 71 is turned off. The rotation of the pickup roller 71 is stopped. The sheet feed tray 56 pivots and raises the end portion in the +X direction of the bundle of sheets SS and the pickup roller 71. When the pickup roller 71 is raised to a predetermined position, the rotation switch of the pickup roller 71 is turned on. The pickup roller 71 rotates and the feed of the sheet S is restarted.

In this application, the W directions (first directions) are directions in which the sheet S is fed from the sheet feed cassette 51. The +W direction (a first side in the first direction) is a downstream side in the direction in which the sheet S is fed. The −W direction (a second side in the first direction) is an upstream side in the direction in which the sheet S is fed and opposite to the +W direction. The sheet feed cassette 51 feeds the sheet S in the +W direction. The cassette front wall 52 is the side wall of the sheet feed cassette 51 in the +W direction of the sheet container space 55.

As shown in FIG. 4, the sheet feeder 50 has the conveyance guide 60, a sheet feed roller 72 and a separation roller 73, and a conveyance roller 75.

The conveyance guide 60 is placed in the +W direction of the sheet feed cassette 51. The conveyance guide 60 guides the conveyance of the sheet S fed in the +W direction from the sheet feed cassette 51. The conveyance guide 60 is formed using a resin material or the like.

The conveyance guide 60 has an upper surface guide 61 and the lower surface guide 62. The upper surface guide 61 and the lower surface guide 62 have plate shapes along the WY-plane. The upper surface guide 61 and the lower surface guide 62 are placed apart in the normal direction of the WY-plane. The upper surface guide 61 can contact the upper surface of the sheet S fed in the +W direction from the sheet feed cassette 51. The lower surface guide 62 can contact the lower surface of the sheet S.

The conveyance guide 60 has the bent portion 65. The bent portion 65 is placed in the +W direction of the upper surface guide 61 and the lower surface guide 62. The bent portion 65 changes the conveyance direction of the sheet S. For example, the bent portion 65 changes the conveyance direction of the sheet S from the +W direction to the +Z direction.

The sheet feed roller 72 and the separation roller 73 are placed in the intermediate part in the W directions of the conveyance guide 60. The sheet feed roller 72 and the separation roller 73 are placed side by side in the normal direction of the WY-plane. The sheet feed roller 72 and the separation roller 73 contact each other and form a nip N. The nip N is placed between the upper surface guide 61 and the lower surface guide 62. The sheet feed roller 72 is placed at the upper surface guide 61 side of the nip N and the separation roller 73 is placed at the lower surface guide 62 side of the nip N.

The sheet feed roller 72 and the separation roller 73 rotate around a rotation axis parallel to the Y directions. The sheet feed roller 72 is rotationally driven by a motor or the like. The separation roller 73 has a torque limiter. A plurality of sheets S may be fed in an overlapping manner from the sheet feed cassette 51. The plurality of sheets S reach the nip N. The lower sheet S stops in the position of the separation roller 73 by the action of the torque limiter of the separation roller 73. The upper sheet S is conveyed in the +W direction by the sheet feed roller 72. After the upper sheet S is conveyed, the stopped lower sheet S is conveyed in the +W direction by the sheet feed roller 72. The sheet feed roller 72 and the separation roller 73 separate the plurality of sheets S overlapping and fed from the sheet feed cassette 51 in the +W direction.

The sheet S shown in FIG. 3 is held in the sheet container space 55 shown in FIG. 5. The sheet S shown in FIG. 3 has the wireless tag T in the end portion in the +X direction in the center portion in the Y directions. The thickness of the sheet S in a part in which the wireless tag T is placed is larger than those in the other parts. As shown in FIG. 5, the bundle of sheets SS in which a plurality of sheets S are stacked in the thickness direction is mounted on the upper surface of the sheet feed tray 56. In the example of FIG. 5, the height in the Z directions of the bundle of sheets SS in the center portion in the Y directions is larger than those of the other parts. The height of the bundle of sheets SS is lower from the center portion to the end portion in the Y directions.

The pickup roller 71 is located in the center portion in the Y directions. The pickup roller 71 contacts the center portion in the Y directions of the bundle of sheets SS in which the height in the Z directions of the bundle of sheets SS is the largest. The pickup roller 71 feeds the uppermost sheet S of the bundle of sheets SS in the +W direction from the sheet feed cassette 51.

A first range RA, a second range RB, and a third range RC are defined as below.

The first range RA is a range in the Y directions occupied by the wireless tag T of the sheet S held in the sheet container space 55. The pair of side guides 54 contact end portions in the Y directions of the bundle of sheets SS and the bundle of sheets SS are aligned in the Y directions. In this state, the range in the Y directions occupied by the wireless tag T of the sheet S is the first range RA. In the Y directions, the width of the first range RA is the same as the width of the wireless tag T. In the example of FIG. 5, the first range RA is located in the center portion in the Y directions of the sheet S and the sheet container space 55.

The second range RB is a range in the Y directions occupied by a part of the cassette front wall 52. The second range RB is a range in the Y directions including at least a part of the first range RA. The first range RA may include the entire of the second range RB and the second range RB may include the entire of the first range RA. The first range RA and the second range RB may only partially overlap. In the example of FIG. 5, the first range RA includes the entire of the second range RB. The second range RB is a first position PA located in the first range RA. The first position PA is an arbitrary position included in the first range RA in the Y directions. For example, the first position PA is a center position in the Y directions of the first range RA.

The third range RC is a range in the Y directions occupied by the sheet container space 55. The sheet container space 55 can hold the maximum standard-size sheets. The maximum standard-size sheet is a standard-size sheet having the largest width in the Y directions of the standard-size sheets on which images can be formed in the image forming apparatus 10. The pair of side guides 54 contact end portions in the Y directions of the largest standard-size sheet. A space inside in the Y directions of the pair of side guides 54 in these positions is the sheet container space 55. The third range RC is slightly narrower than the width in the Y directions inside of the sheet feed cassette 51.

End positions PB of the cassette front wall 52 are positions of the end portions in the Y directions of the third range RC.

The height in the Z directions of the cassette front wall 52 is as follows. The height in the Z directions in the third range RC except the second range RB is smaller than the height in the Z directions in the second range RB. In the example of FIG. 5, the height in the Z directions in the third range RC except the first position PA is smaller than the height in the Z directions in the first position PA. In the third range RC, the height in the Z directions in the first position PA is the largest. The heights in the Z directions in the end positions PB are smaller than the height in the Z directions in the first position PA. From the first position PA to the end positions PB, the heights in the Z directions are linearly smaller.

The thickness of the sheet S in the first range RA in which the wireless tag T is placed is larger than those of the other parts. The height in the Z directions of the uppermost sheet S of the bundle of sheets SS is larger in the first range RA and smaller in the third range RC except the first range RA. The pickup roller 71 rotates and the uppermost sheet S is fed in the +W direction. The cassette front wall 52 is located in the +W direction of the sheet feed cassette 51. The height in the Z directions of the cassette front wall 52 is larger in the second range RB (first position PA) including at least a part of the first range RA and smaller in the third range RC except the second range RB. When the sheet S is fed in the +W direction, the sheet S is hard to collide with the cassette front wall 52. The feeding failure of the sheet S is suppressed. Even when many sheets S are mounted on the sheet feed tray 56, the feeding failure of the sheets S is suppressed. It is no longer necessary to replenish a small number of sheets S at many times and the burden on the user is reduced.

A fourth range RD of the lower surface guide 62 is defined as follows.

The fourth range RD is a range in the Y directions including at least a part of the first range RA. The first range RA may include the entire of the fourth range RD and the fourth range RD may include the entire of the first range RA. The first range RA and the fourth range RD may partially overlap. In the example of FIG. 5, the first range RA includes the entire of the fourth range RD. In the Y directions, the fourth range RD is located at the center of the first range RA.

End positions PE of the lower surface guide 62 are positions of the end portions in the Y directions of the third range RC.

The height in the Z directions in the end portion in the −W direction of the lower surface guide 62 is as follows. The heights in the Z directions in the fourth range RD are equal. The height in the Z directions in the third range RC except the fourth range RD is smaller than the height in the Z directions in the fourth range RD. In the third range RC, the height in the Z directions in the fourth range RD is the largest. In the example of FIG. 5, the heights in the Z directions in the end positions PE are smaller than the height in the Z directions in the fourth range RD. From end portions to the end positions PE of the fourth range RD, the heights in the Z directions are linearly smaller.

In the entire of the third range RC, the height in the Z directions in the end portion in the −W direction of the lower surface guide 62 is smaller than the height in the Z directions of the cassette front wall 52. The height in the Z directions in the fourth range RD of the lower surface guide 62 is smaller than the height in the Z directions in the first position PA of the cassette front wall 52. The heights in the Z directions in the end positions PE of the lower surface guide 62 are smaller than the heights in the Z directions in the end positions PB of the cassette front wall 52.

The uppermost sheet S of the bundle of sheets SS is fed from the sheet feed cassette 51 and passed to the conveyance guide 60. The height in the Z directions of the uppermost sheet S is larger in the first range RA and smaller in the third range RC except the first range RA. The height in the Z directions of the lower surface guide 62 of the conveyance guide 60 is larger in the fourth range RD including at least a part of the first range RA and smaller in the third range RC except the fourth range RD. The height in the Z directions in the end portion in the −W direction of the lower surface guide 62 is smaller than the height in the Z directions of the cassette front wall 52. The sheet S fed from the sheet feed cassette 51 is hard to collide with the end portion in the −W direction of the lower surface guide 62. The feeding failure of the sheet S is suppressed.

As shown in FIG. 6, an opening portion 63 is formed in the fourth range RD of the lower surface guide 62. The separation roller 73 projects in the +Z direction of the lower surface guide 62 through the opening portion 63. In the Y directions, the width of the fourth range RD is larger than the width of the separation roller 73. The entire of the separation roller 73 is housed inside of the fourth range RD. The heights in the Z directions of the lower surface guide 62 are equal in the entire of the fourth range RD. The heights of the projection of the separation roller 73 from the lower surface guide 62 in the +Z direction are equal in the entire in the Y directions.

As shown in FIG. 4, the bent portion 65 of the conveyance guide 60 is located in the +W direction of the lower surface guide 62. In the end portion in the +W direction of the lower surface guide 62, the heights in the Z directions in the third range RC are equal. In the end portion in the +W direction of the lower surface guide 62, the heights in the Z directions in the center portion and the end portions in the Y directions are equal.

The height in the Z directions of the sheet S passed from the sheet feed cassette 51 to the conveyance guide 60 is larger in the first range RA and smaller in the third range RC except the first range RA. In the process of the conveyance of the sheet S along the lower surface guide 62, the orientation of the sheet S is corrected. In the end portion in the +W direction of the lower surface guide 62, the heights in the Z directions of the sheet S are equal in the entire in the Y directions. In this orientation, the sheet S enters the bent portion 65. The sheet S passes through the bent portion 65 while being smoothly deformed along the bent portion 65. In the bent portion 65, the sheet S is hard to jam, the sheet S is hard to wrinkle, and noise is hard to be made from the sheet S. The feeding failure of the sheet S is suppressed.

As shown in FIG. 5, the height in the Z direction of the cassette front wall 52 is larger in the first position PA. When the sheet S is fed from the sheet feed cassette 51, the lower surface of the sheet S and the first position PA of the cassette front wall 52 may contact.

As seen from the +W direction of the cassette front wall 52, the shape of the first position PA of the cassette front wall 52 is an arc shape such as a circular arc shape. The first position PA of the cassette front wall 52 is subjected to round-chamfering or the like. The sheet S is hard to be caught by the cassette front wall 52. The feeding failure of the sheet S is suppressed.

The sheet S shown in FIG. 3 is a regular sheet recommended to be used in the sheet feeder 50 shown in FIG. 5. The regular sheet is the sheet S having the wireless tag T in the end portion in the +X direction in the center portion in the Y directions. Information of the regular sheet is displayed on the upper surface of the sheet feed tray 56 or the like. The user of the image forming apparatus 10 checks the display of the regular sheet and loads the regular sheets on the upper surface of the sheet feed tray 56. The height of the bundle of sheets SS mounted on the upper surface of the sheet feed tray 56 is the largest in the center portion in the Y directions.

The pickup roller 71 is placed in the center portion in the Y directions. The pickup roller 71 contacts the highest portion of the bundle of sheets SS and feeds the sheet S from the sheet feed cassette 51. The second range RB of the cassette front wall 52 includes at least a part of the first range RA occupied by the wireless tag T. Regarding the heights in the Z directions of the cassette front wall 52, the height in the third range RC except the second range RB is smaller than the height in the second range RB. The sheet S is hard to collide with the cassette front wall 52. The fourth range RD of the lower surface guide 62 includes at least a part of the first range RA occupied by the wireless tag T. Regarding the heights in the Z directions in the end portion in the −W direction of the lower surface guide 62, the height in the third range RC except the fourth range RD is smaller than the height in the fourth range RD. The sheet S is hard to collide with the lower surface guide 62. According to the above described configuration, the feeding failure of the sheet S is suppressed.

In the sheet feeder 50, an irregular sheet having the wireless tag T in another portion than the center portion in the Y directions can be used. For example, as the irregular sheet, a second sheet having the wireless tag T in the end portion in the +X direction in the end portion in the +Y direction may be used. The height in the Z directions of a bundle of the second sheets mounted on the upper surface of the sheet feed tray 56 is larger in the end portion in the +Y direction and smaller in the end portion in the −Y direction.

A service person for the image forming apparatus 10 changes the configuration of the sheet feeder 50.

The pickup roller 71 is movably formed in the Y directions. The service person moves the pickup roller 71 to the end portion in the +Y direction. The pickup roller 71 contacts the highest portion in the Z directions of the bundle of second sheets and feeds the second sheet from the sheet feed cassette 51 in the +W direction.

The cassette front wall 52 is formed detachably from the sheet feed cassette 51. The service person replaces the cassette front wall 52 of the embodiment by a second cassette front wall. The second range of the second cassette front wall includes at least a part of the first range occupied by the wireless tag T. Regarding the heights in the Z directions of the second cassette front wall, the height in the third range RC except the second range is smaller than the height in the second range. The height in the Z directions of the second cassette front wall is larger in the end portion in the +Y direction and smaller in the end portion in the −Y direction. The second sheet is hard to collide with the second cassette front wall. The feeding failure of the sheet S is suppressed.

The lower surface guide 62 shown in FIG. 4 is formed detachably from the conveyance guide 60. The service person replaces the lower surface guide 62 of the embodiment by a second lower surface guide. The fourth range of the second lower surface guide includes at least a part of the first range occupied by the wireless tag. Regarding the heights in the Z directions in the end portion in the −W direction of the second lower surface guide, the height in the third range RC except the fourth range is smaller than the height in the fourth range. The height in the Z directions in the end portion in the −W direction of the second lower surface guide is larger in the end portion in the +Y direction and smaller in the end portion in the −Y direction. The second sheet is hard to collide with the second lower surface guide. The feeding failure of the sheet S is suppressed.

Instead of the service person changing the configuration of the sheet feeder 50, the control unit 100 may automatically change the configuration of the sheet feeder 50. The sheet feeder 50 has a sensor sensing the position of the wireless tag T of the sheet S. The control unit 100 moves the pickup roller 71 in the Y directions according to the position in the Y directions of the wireless tag T. The control unit 100 changes the height in the Z directions in the third range RC of the cassette front wall 52 according to the position in the Y directions of the wireless tag T. The control unit 100 changes the height in the Z directions in the third range RC of the lower surface guide 62 according to the position in the Y directions of the wireless tag T. Thereby, the feeding failure of the sheet S is suppressed.

In the above described embodiment, the second range RB (first position PA) and the fourth range RD are located in the center portion of the first range RA in the Y directions. On the other hand, the second range RB and the fourth range RD may be located in another portion than the center portion of the first range RA. The second range RB and the fourth range RD may be located in different positions from each other.

According to at least one embodiment described above, the cassette front wall 52 in which the height in the Z directions in the third range RC except the second range RB is smaller than the height in the Z directions in the second range RB including at least a part of the first range RA is provided. Thereby, the feeding failure of the sheet S may be suppressed.

While certain embodiments have been described, these embodiments are presented as examples, but not intended to limit the scope of the invention. These novel embodiments may be implemented in other various forms and various omissions, replacements, changes may be made without departing from the scope of the invention. These embodiments or their modifications are within the scope of the invention and within the scope of the invention described in claims and equivalents thereof.

What is claimed is:

1. A sheet feeder, comprising:

a cassette having a sheet container space configured to hold a sheet having a wireless tag, the cassette configured to feed the sheet to a first side in a first direction, wherein the cassette comprises a cassette front wall that is a retaining wall of the cassette at the first side in the first direction of the sheet container space for retaining the sheet within the sheet container space, wherein a horizontal direction orthogonal to the first direction is a second direction, a range in the second direction occupied by the wireless tag of the sheet held in the sheet container space is a first range, a range in the second direction including at least a part of the first range is a second range, and a range in the second direction occupied by the sheet container space is a third range, and wherein a first height of the cassette front wall in a vertical direction in the third range, except the second range, is smaller than a second height of the cassette front wall in the vertical direction in the second range; and a lower surface guide located at the first side in the first direction of the cassette to contact a lower surface of the sheet fed from the cassette, the lower surface guide configured to guide conveyance of the sheet, wherein a front portion of the lower surface guide, that faces the cassette front wall, is disposed lower than a center height of the cassette front wall at a center of the first range, wherein the lower surface guide extends along the second direction to opposite end portions of the lower surface guide, and wherein a fourth range of the lower surface guide, that at least partially overlaps with the first range, has a third height in the vertical direction that is greater than fourth heights of the lower surface guide at the opposite end portions of the lower surface guide.

2. The sheet feeder according to claim 1, further comprising:

a bent portion located at the first side in the first direction of the lower surface guide, the bent portion configured to change a conveyance direction of the sheet, wherein the fourth heights are equal to one another.

3. The sheet feeder according to claim 2, wherein the second range is a first position in the first range, and as seen from the first side in the first direction of the cassette front wall, a shape of the first position of the cassette front wall is an arc shape.

4. The sheet feeder according to claim 2, further comprising a wireless tag communication device configured to communicate with the wireless tag.

5. The sheet feeder according to claim 1, wherein the second range is a first position in the first range, and as seen from the first side in the first direction of the cassette front wall, a shape of the first position of the cassette front wall is an arc shape.

6. The sheet feeder according to claim 1, further comprising a wireless tag communication device configured to communicate with the wireless tag.

7. The sheet feeder according to claim 1, further comprising a sheet feed roller, a separation roller, and a conveyance roller.

8. The sheet feeder according to claim 1, further comprising:

a pair of rollers comprising a pickup roller that feeds the sheet from the sheet container space and a sheet feed roller that guides the sheet along the lower surface guide, wherein the front portion of the lower surface guide is spaced from the cassette front wall and is disposed along the first direction of the sheet between the pair of rollers.

9. An image forming apparatus, comprising:

a control panel;

a wireless tag communication device;

a printer; and a sheet feeder, comprising:

a cassette having a sheet container space configured to hold a sheet having a wireless tag, the cassette configured to feed the sheet to a first side in a first direction, wherein the cassette comprises a cassette front wall that is a retaining wall of the cassette at the first side in the first direction of the sheet container space for retaining the sheet within the sheet container space, wherein a horizontal direction orthogonal to the first direction is a second direction, a range in the second direction occupied by the wireless tag of the sheet held in the sheet container space is a first range, a range in the second direction including at least a part of the first range is a second range, and a range in the second direction occupied by the sheet container space is a third range, and wherein a first height of the cassette front wall in a vertical direction in the third range, except the second range, is smaller than a second height of the cassette front wall in the vertical direction in the second range; and a lower surface guide located at the first side in the first direction of the cassette to contact a lower surface of the sheet fed from the cassette, the lower surface guide configured to guide conveyance of the sheet, wherein a front portion of the lower surface guide, that faces the cassette front wall, is disposed lower than a center height of the cassette front wall at a center of the first range, wherein the lower surface guide extends along the second direction to opposite end portions of the lower surface guide, and wherein a fourth range of the lower surface guide, that at least partially overlaps with the first range, has a third height in the vertical direction that is greater than fourth heights of the lower surface guide at the opposite end portions of the lower surface guide.

10. The image forming apparatus according to claim 9, further comprising a bent portion located at the first side in the first direction of the lower surface guide, the bent portion configured to change a conveyance direction of the sheet, wherein the fourth heights are equal to one another.

11. The image forming apparatus according to claim 10, wherein the second range is a first position in the first range, and as seen from the first side in the first direction of the cassette front wall, a shape of the first position of the cassette front wall is an arc shape.

12. The image forming apparatus according to claim 10, further comprising a wireless tag communication device configured to communicate with the wireless tag.

13. The image forming apparatus according to claim 9, wherein the second range is a first position in the first range, and as seen from the first side in the first direction of the cassette front wall, a shape of the first position of the cassette front wall is an arc shape.

14. The image forming apparatus according to claim 9, further comprising a wireless tag communication device configured to communicate with the wireless tag.

15. The image forming apparatus according to claim 9, further comprising a sheet feed roller, a separation roller, and a conveyance roller.

16. The image forming apparatus according to claim 9, further comprising:

a pair of rollers comprising a pickup roller that feeds the sheet from the sheet container space and a sheet feed roller that guides the sheet along the lower surface guide, wherein the front portion of the lower surface guide is spaced from the cassette front wall and is disposed along the first direction of the sheet between the pair of rollers.

17. A sheet feeder, comprising:

a cassette having a sheet container space configured to hold a sheet having a wireless tag, the cassette configured to feed the sheet to a first side in a first direction, wherein the cassette comprises a cassette front wall that is a retaining wall of the cassette at the first side in the first direction of the sheet container space for retaining the sheet within the sheet container space, wherein a horizontal direction orthogonal to the first direction is a second direction, a range in the second direction occupied by the wireless tag of the sheet held in the sheet container space is a first range, a range in the second direction including at least a part of the first range is a second range, and a range in the second direction occupied by the sheet container space is a third range, and wherein a first height of the cassette front wall in a vertical direction in the third range, except the second range, is smaller than a second height of the cassette front wall in the vertical direction in the second range;

a lower surface guide located at the first side in the first direction of the cassette, contacting a lower surface of the sheet fed from the cassette, the lower surface guide configured to guide conveyance of the sheet, wherein, when an opposite side to the first side in the first direction is a second side in the first direction and a range in the second direction including at least a part of the first range is a fourth range of the lower surface guide, in an end portion at the second side in the first direction of the lower surface guide, a third height in the vertical direction in the third range except the fourth range is smaller than fourth heights in the vertical direction in the fourth range, wherein, in a front portion at the first side in the first direction of the lower surface guide, the fourth heights in the vertical direction, at opposite sides of the front portion of the lower surface guide, are equal, and wherein the lower surface guide comprises a bent portion located at the first side in the first direction of the lower surface guide, the bent portion configured to change a conveyance direction of the sheet that is guided along the lower surface guide.

* * * * *